United States Patent [19]

Rubbo et al.

[11] Patent Number: 5,044,441

[45] Date of Patent: Sep. 3, 1991

[54] PACK-OFF WELL APPARATUS AND METHOD

[75] Inventors: Dick Rubbo, The Woodlands; Mike Luke, Pasadena; Brett Bouldin; Frank Mooney, both of Friendswood, all of Tex.

[73] Assignee: Baker Hughes Incorporated, Houston, Tex.

[21] Appl. No.: 574,435

[22] Filed: Aug. 28, 1990

[51] Int. Cl.[5] ..... E21B 33/129; E21B 34/10; E21B 23/00

[52] U.S. Cl. ..... 166/382; 166/120; 166/126; 166/385; 166/387; 166/237

[58] Field of Search ..... 166/382, 385, 386, 387, 166/120, 126, 72, 134, 142, 143, 374, 237

[56] References Cited

U.S. PATENT DOCUMENTS

| | | | |
|---|---|---|---|
| 4,305,465 | 12/1981 | Ellis | 166/120 X |
| 4,432,417 | 2/1984 | Bowyer | 166/120 |
| 4,479,548 | 10/1984 | Gilbert | 166/387 |
| 4,513,822 | 4/1985 | Gilbert | 166/217 X |
| 4,646,842 | 3/1987 | Arnold et al. | 166/382 |
| 4,711,326 | 12/1987 | Baugh et al. | 166/217 X |

OTHER PUBLICATIONS

Baker Oil Tools Safety Systems Catalog, Mar. 1989, pp. 40 and 41.

Engineering Drawing of Baker Model "DGH" Pack--Off Tubing Hanger, Feb. 10, 1986.

Mechanical Drawing of Baker Single Stream Tubing Hanger Unit 3557, 10/21/76.

Mechanical Engineering Drawing of Baker Model "RC" Pack-Off Tubing Hanger, Feb. 10, 1986.

Baker Model "B" Pack-Off Tubing Hanger, 11/16/81.

*Primary Examiner*—Stephen J. Novosad

*Attorney, Agent, or Firm*—Charles D. Gunter, Jr.

[57] ABSTRACT

A pack-off tubing hanger is shown for use in a tubing string extending from a well surface location to a downhole location within a well casing. The hanger body includes an external packing element and gripping slips which support the hanger body within the surrounding casing. A longitudinal passageway communicates hydraulic pressure from the lower end of the hanger to a setting chamber to hydraulically set the packing elements and actuate the gripping slips. A companion concentric tubing anchor is carried within the internal bore of the hanger and connects the hanger to the tubing string leading to the well surface.

37 Claims, 11 Drawing Sheets

BEST AVAILABLE COPY

BEST AVAILABLE COPY

BEST AVAILABLE COPY

BEST AVAILABLE COPY

BEST AVAILABLE COPY

PACK-OFF WELL APPARATUS AND METHOD

BACKGROUND OF THE INVENTION

1. Field of the Invention

The present invention relates to well devices employed in the completion and production of oil and gas wells. More specifically, the invention relates to a well tubing hanger which is retrievably anchored in a subsurface location within a well casing or other well conduit and to a cooperating concentric tubing anchor used to anchor a tubing string extending from the well surface within the tubing hanger.

2. Description of the Prior Art

Anchor-seal assemblies of various types have been used in the past in well working operations, and in the production of a well. For instance, seal assemblies in the form of packers are known for isolating formations for treatment, or for isolating segments of liners or well casings. Packers are routinely used for sealing production strings to well liners or well casings to define flow paths from producing formations to the well surface.

Particularly in the case of packers, the seal assembly is usually positioned within a well by means of a pipe string, and then set in sealing and anchoring engagement with the surrounding conduit. The setting operation usually involves the movement of multiple components of the packer to expand one or more resilient seal members, and to wedge anchoring slips against the surrounding well conduit or casing.

In spite of advances in the art, a need exists for a pack-off well apparatus which is adapted for specific, demanding environments. For example, in gas injection operations, a tubing hanger is needed which is capable of anchoring and sealing a well tubing string in a borehole, the tubing hanger having an extremely high axial load capability.

A need also exists for such a pack-off apparatus which can be used for gas injection operations where temperature changes subject the apparatus to large static loads.

A need also exists for such an apparatus which can serve as a redundant wellhead when set at a shallow depth in a borehole.

It is an object of the present invention to provide a tubing hanger with an axial load capability which is substantially equivalent to the load capability of the tubing string supported by the tubing hanger.

Another object of the invention is to provide a tubing hanger adapted for gas injection processes which can be set at a shallow depth below the well surface and which can tolerate the large static loads encountered due to temperature requirements encountered during such operations.

Another object of the invention is to provide such a tubing hanger which cannot be inadvertently pulled from the anchored location in the well casing by an impact to the upstream equipment located at the well surface such as might occur if an ocean vessel inadvertently rammed the surface structures.

Another object is to provide a tubing hanger which eliminates flow ports in the production tubing or work string, or a component in direct fluid communication therewith, to provide actuating fluid from the bore of the production tubing to well tools to initiate desired operations, such as the setting of the packing element. Seals employed with such ports must be sealed in subsequent operations and are subject to deterioration and hence leakage.

Additional objects, features and advantages will be apparent in the written description which follows.

SUMMARY OF THE INVENTION

The present pack-off apparatus is designed for extremely high axial load capability. In its preferred environment, the present apparatus is set at a shallow depth, e.g., 100–4,000 feet below the well surface and serves as a redundant wellhead with packers and other production equipment supported below. The apparatus is also designed to accept a cooperating Concentric Tubing Anchor (CTA). The CTA includes inner and outer concentric tubular bodies which allow gas injection through an annular flow path created between concentric tubing bodies, through the interior of the tubing hanger and out ports provided in the hanger body below the annular packing element. In this way, gas injected through the annular flow path and out the injection ports co-mingles with production fluids in the surrounding formation, thereby providing artificial lift for these fluids. The gas-fluid mixture is then returned through the inner concentric tubular body of the CTA and passes up the interior of the tubing string leading to the well surface.

In its preferred form, the apparatus of the invention comprises a pack-off tubing hanger designed to support a tubing string extending from a well surface location to a downhole location within a surrounding subterranean formation lined with a well casing. The tubing hanger includes a generally cylindrical hanger body having an upper end and a lower end, the hanger body being adapted to be supported in the surrounding well casing. The hanger body has a longitudinal axis, cylindrical sidewall portions and an internal bore.

An annular packing element is carried about the hanger body which is radially expandable under axial compression. A setting sleeve is carried about the hanger body. The setting sleeve is axially moveable with respect to the packing element for compressing the packing element. The setting sleeve has an upper end adapted to contact the packing element and has a lower end, the lower end of the setting sleeve being slidably received within the interior of a circumscribing member which defines a setting chamber on the exterior of the hanger body. An anti-preset piston is carried about the hanger body below the setting sleeve. The anti-preset piston has an engagement end which initially locks the setting sleeve in a running-in position. The anti-preset piston is axially moveable in an opposite direction from the setting sleeve to release the setting sleeve and set the packing element upon the application of hydraulic pressure to the setting chamber.

A plurality of circumferentially spaced slips are carried on the exterior of the hanger body. The slips have outer gripping surfaces adapted to grip the surrounding well casing. The slips are actuable by axial movement of the anti-preset piston to grip the well casing and support the hanger body within the well casing. The hanger body has a longitudinal passageway for communicating hydraulic pressure to the setting chamber, the longitudinal passageway extending from a point adjacent the lower end of the device upwardly along the longitudinal axis of the hanger body to the setting chamber.

Preferably, the longitudinal passageway is a gun drilled hole which extends from the lower end of the device to the setting chamber used to set the packing element.

A cooperating Concentric Tubing Anchor (CTA) can be located within the internal bore of the hanger body. The CTA has an external latch profile adapted to be engaged with an internal thread profile of the hanger body. The preferred CTA has an upper extent which carries a latch assembly for engaging the mating thread profile of the interior of the hanger body and a lower, tubular extent which extends within the interior of the hanger body to a point below the gripping slips. The CTA has upper and lower seal regions which are located above and below the packing element within the interior of the hanger body when the latch assembly engages the interior of the hanger body. The CTA has an outer tubing body and a concentrically located inner tubing body at the upper extent thereof. The outer an inner tubular bodies define an annular flow path which extends from the upper extent of the CTA to the lower extent thereof. Flow ports are located in the hanger body below the packing element. The flow ports are arranged in communication with the annular flow path defined by the inner and outer concentric tubular bodies of the CTA. Fluid pumped down the annular flow path passes to the exterior of the pack-off tubing hanger to an annular area of the borehole located below the packing element when the packing element is set in engagement with the surrounding well casing.

An axially slidable closing sleeve is carried within the interior bore of the hanger body. The closing sleeve has an engagement region which is engageable by the tubular portion of the CTA as the CTA is inserted and withdrawn from the internal bore of the hanger body. The closing sleeve is provided with axially-spaced seal regions which alternately close the flow ports to the exterior of the tubing hanger as the CTA is withdrawn and open the flow ports as the CTA is inserted within the internal bore of the tubing hanger.

The CTA is preferably provided with a downwardly extending latch collet supported on the outer tubular body thereof. The latch collet has a plurality of externally threaded collet fingers which are adapted to matingly engage an internal thread profile provided in the internal bore of the surrounding hanger body to thereby latch the CTA in a latched position within the hanger body. The inner tubular body has alternating external support lands which underlie the externally threaded collet fingers in the latched position. The alternating support lands of the inner tubular body are axially shiftable from beneath the externally threaded collet fingers in a release position. The inner tubular body has a cylindrical fixed portion and an axially aligned actuating portion which is axially shiftable to move the alternating support lands to the release position and actuate the release of the concentric tubing anchor from within the hanger body. Preferably, the inner tubular body is initially connected to the axially aligned, actuating portion by a severable joint which can be severed upon the application of a predetermined tension load by a suitable release tool.

In certain operational sequences, stop means can be provided in the exterior of the outer tubular body for initially preventing downward movement of the outer tubular body relative to the hanger body and for preventing the externally threaded collet fingers from engaging the internally threaded profile provided in the internal bore of the hanger body. In the preferred embodiment, the stop means includes a stop ring which is located in a recess provided on the exterior of the outer tubular body. The recess includes a ramp region which allows downward movement of the stop ring as the outer tubular body is moved upwardly within the surrounding hanger body but which initially prohibits downward movement of the outer tubular body within the surrounding hanger body.

Connecting means, located on the exterior of the outer tubular body, initially connect the CTA to the surrounding hanger body in order to deactivate the stop means. The connecting means is preferably formed as a double lobed C-ring having oppositely arranged lobes which extend radially outward from the exterior of the outer tubular body. One of the lobes is adapted to engage a mating groove provided within the internal bore of the hanger body and the opposite lobe is engaged within an internal recess of a triggering ring provided on the exterior of the outer tubular body. The triggering ring has an internal shoulder which is adapted to engage the stop ring located on the exterior of the outer tubular body for moving the stop ring up the ramp region.

An indexing groove is provided on the exterior of the outer tubular body for receiving the stop ring. After the stop ring passes over the ramp region, the depth of the indexing groove increases. The stop ring is now removed from contact with the internal shoulder of the triggering ring. This allows the CTA to move downwardly relative to the hanger body to thereby latch the latch collet within the mating internal thread profile provided within the internal bore of the surrounding hanger body.

DETAILED DESCRIPTION OF THE INVENTION

Figure 1:
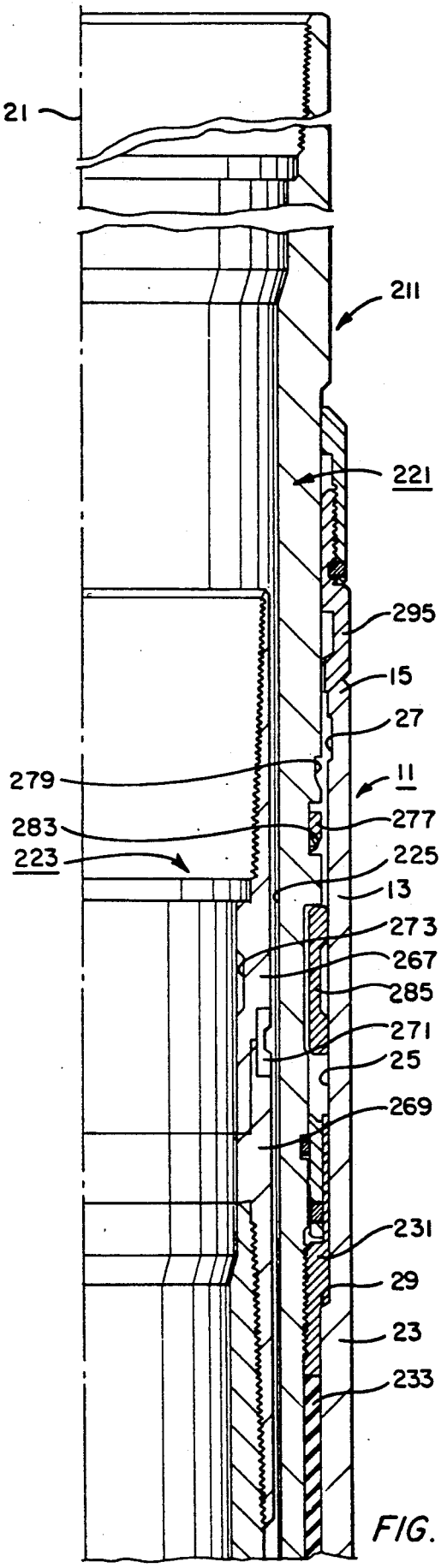
FIG. 1 is a quarter-sectional view of the upper most end of the pack-off tubing hanger of the invention showing the concentric tubing anchor received within the internal bore thereof.
Figure 11:
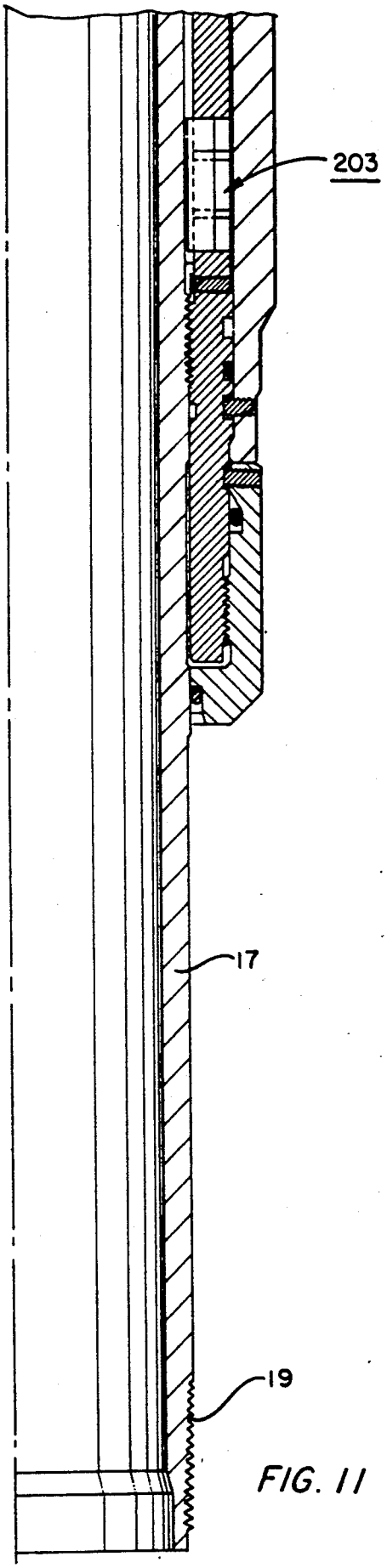
Figure 12:
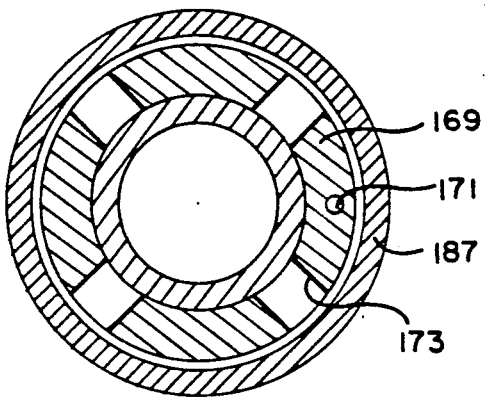
FIG. 12 is a cross-sectional view taken along lines XII—XII in FIG. 8.

FIG. 1 shows the upper most end of a pack-off tubing hanger of the invention designated generally as 11. The tubing hanger 11 is used for supporting a tubing string extending from a well surface location to a downhole location within a surrounding subterranean formation lined with a well casing (not shown). The tubing hanger 11 includes a generally cylindrical hanger body 13 which has an upper end 15 and a lower end 17 (FIG. 11). As will be described, the hanger body 13 includes a plurality of tubular portions which are threadedly engaged between the upper end 15 and lower end 17. The lower end 17 has an externally threaded pin end 19 which is adapted to engage a mating box connection on a production string leading to a packer and additional production equipment supported below the tubing hanger in the well bore in conventional fashion.

The hanger body 13 (FIG. 1) has a longitudinal axis 21, cylindrical sidewall portions 23 and an internal bore 25. As shown in FIG. 1, the internal bore includes a mating groove 27 provided within the internal bore 25 of the hanger body for engaging a connecting means for connecting a Concentric Tubing Anchor (CTA) to the surrounding hanger body. The internal bore 25 of the hanger body 13 also includes a locating shoulder 29 for locating the CTA within the internal bore, as will be described.

Figure 3:
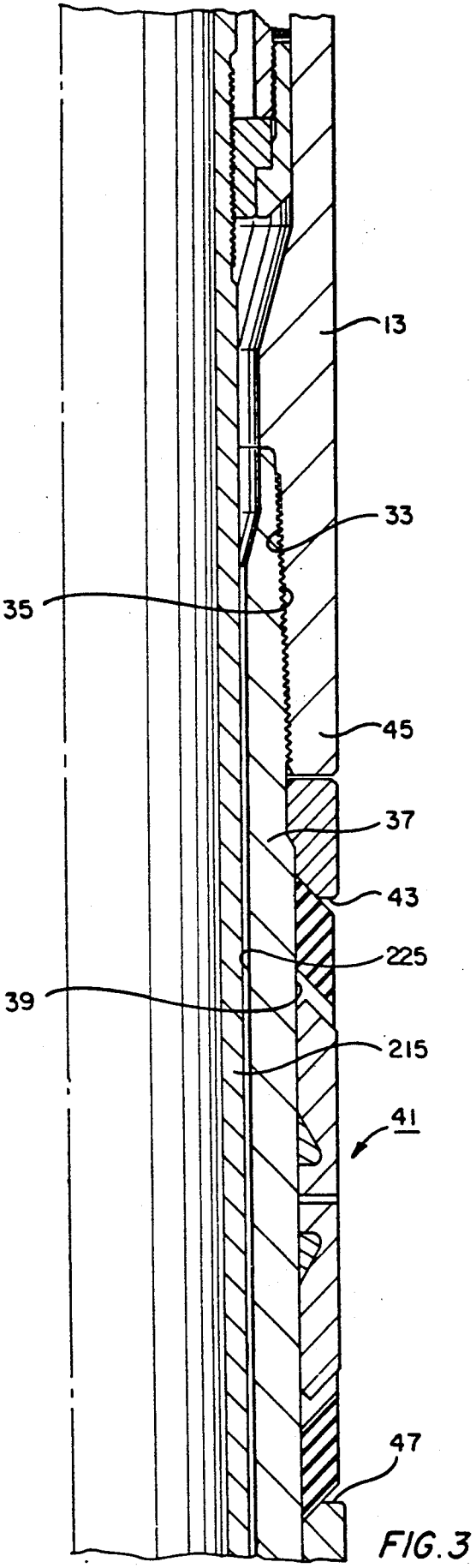
FIG. 3 is a downward continuation of FIG. 2 showing the packing element located on the exterior of the tubing hanger.

As shown in FIG. 3, the upper most extent of the hanger body 13 includes an internally threaded surface 33 for engaging an externally threaded surface 35 of a downwardly extending cylindrical body portion 37 of the hanger body 13. The downwardly extending body portion 37 includes a region of reduced external diameter 39 for receiving an annular packing element 41. The annular packing element 41 will be familiar to those skilled in the art and includes one or more elastomeric regions which are radially expandable under axial compression. The packing element 41 is expanded outwardly between an upper shoulder ring 43 fixed in position by the lower extent 45 of the body portion and the lower shoulder region 47 of a setting sleeve 49 which is carried about the external diameter 39 of the downwardly extending body portion 37 of the hanger body 13.

Figure 4:
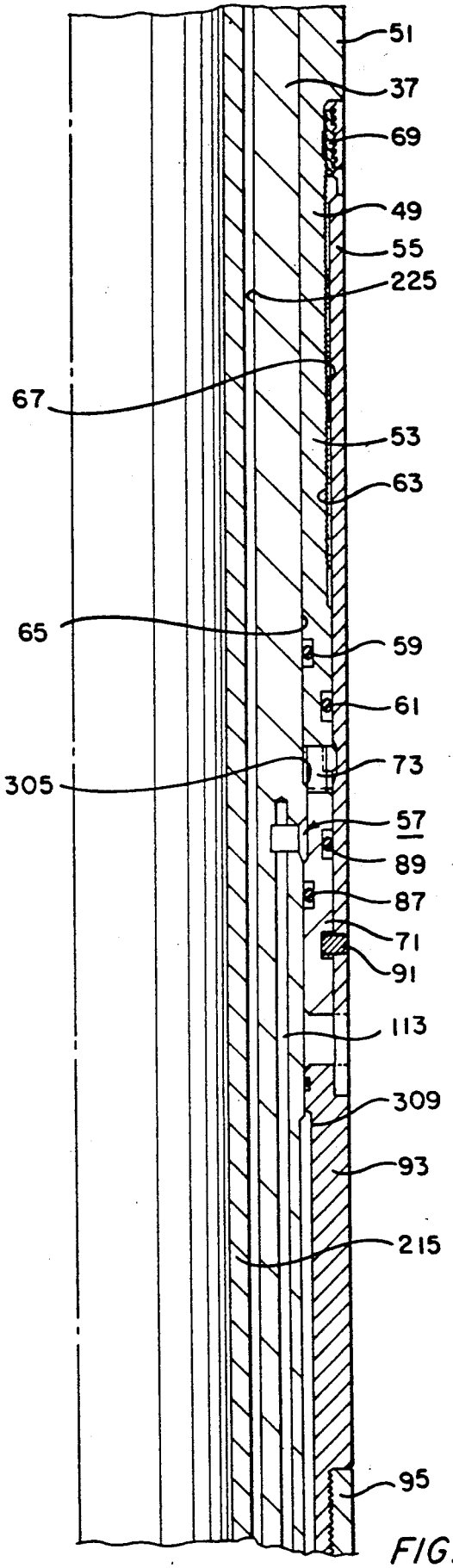
FIG. 4 is a downward continuation of FIG. 3 showing the setting chamber and setting sleeve used to set the packing element.

The setting sleeve 49 includes an upper region 51 of relatively greater external diameter and a lower region 53 of lesser relative external diameter which circumscribes the downwardly extending body portion 37. The setting sleeve 49 thus has an upper end which includes the lower shoulder region 47 which contacts the packing element 41 and has a lower end region 53 which is slidably received within the interior of a circumscribing member 55 which defines a setting chamber 57 on the exterior of the hanger body. As shown in FIG. 4, O-ring seals 59, 61 are provided in mating grooves on the interior and exterior, respectively, of the setting sleeve lower end region 53 for sealingly engaging the internal diameter 63 of the circumscribing member 55 and the external diameter 65 of the body portion 37, respectively. The lower end region 53 of the setting sleeve 49 also has a ratchet region 67 on the exterior thereof for engaging a body lock ring 69 which allows upward movement of the setting sleeve 49, as viewed in FIG. 4 but which prohibits downward movement of the setting sleeve 49 after the rachet region 67 has engaged the teeth of the body lock ring 69.

An anti-preset piston 71 is carried about the hanger body portion 37 below the setting sleeve 49, the anti-preset piston 71 having an engagement end 73 which initially locks the setting sleeve in a running-in position. The anti-preset piston is axially moveable in an opposite direction from the setting sleeve 49 to release the setting setting sleeve and set the packing element upon the application of hydraulic pressure to the setting chamber 57.

Figure 15:
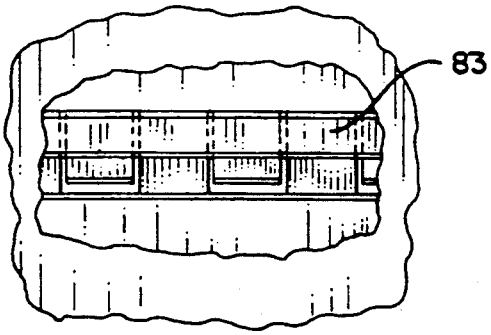
FIG. 15 is an isolated, top view of the engagement means initially used to engage the anti-preset piston with the setting sleeve in the running-in position.
Figure 16:
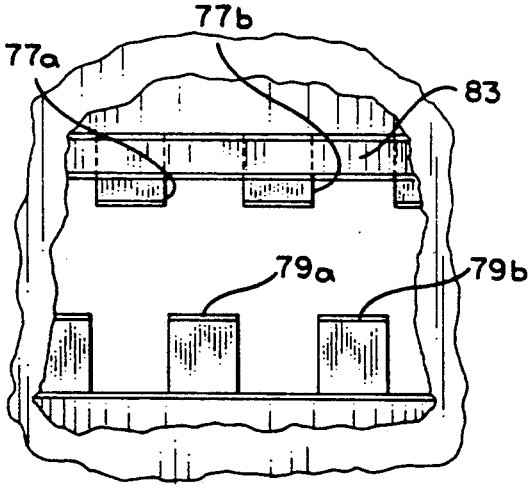
FIG. 16 is a view similar to FIG. 15 showing the separation of the anti-preset position as hydraulic pressure is applied to the setting chamber.
Figure 17:
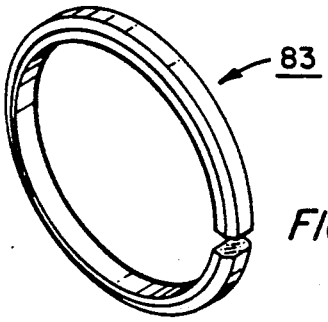
FIG. 17 is an isolated, perspective view of the snap ring which is used to initially engage the setting sleeve with the anti-preset piston.

Preferably, the setting sleeve lower end region 53 is provided with a plurality of downwardly extending fingers 75 which define circumferentially spaced end slots (77*a*, 77*b* in FIG. 16) between each finger 75. The engagement end 73 of the anti-preset piston 71 is provided with upwardly extending fingers (79*a*, 79*b* in FIG. 16) which are received within the setting sleeve end slots when the setting sleeve is locked in the running-in position (see FIG. 15). The setting sleeve fingers 75 have a circumferential groove 81 (FIG. 14) cut therein which contains a snap ring 83. The circumscribing member 55 has an internal shoulder 85 which engages the snap ring 83 when the engagement end 73 of the anti-preset piston 71 locks the setting sleeve 49 in the running-in position.

Figure 13:
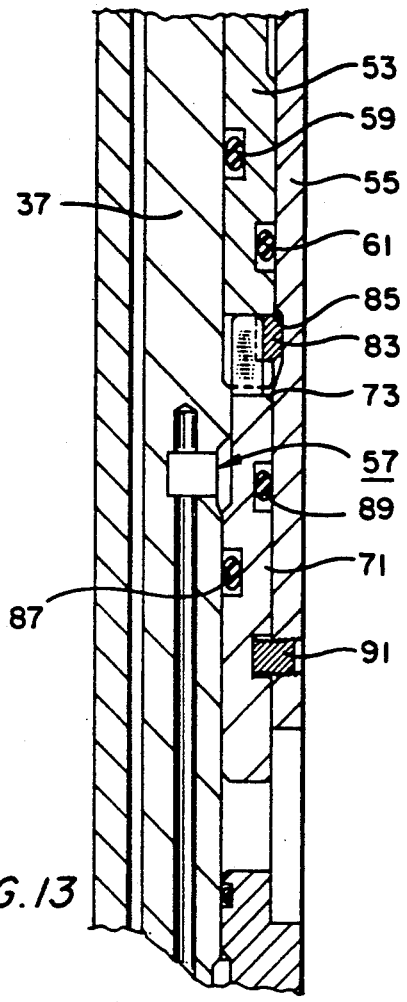
FIG. 13 is an enlarged, quarter-sectional view of the setting chamber of the device showing the anti-preset piston engaged with the setting sleeve.
Figure 14:
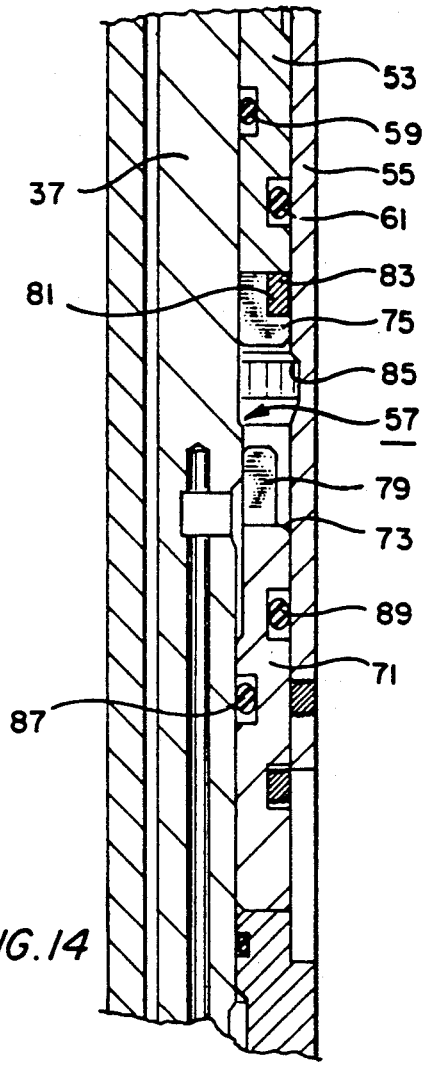
FIG. 14 is a view similar to FIG. 13 showing the disengagement of the setting sleeve during the setting operation.

As shown in FIGS. 13 and 14, the upwardly extending fingers 79 of the anti-preset piston 71 initially underlie the snap ring 83 of the setting sleeve 49 when in the running-in position, whereby the snap ring 83 engages the internal shoulder 85 of the circumscribing member 55. The upwardly extending fingers 79 are axially moveable from beneath the snap ring to a release position which frees the snap ring 83 from the internal shoulder 85 upon the application of hydraulic pressure to the setting chamber 57.

The anti-preset piston 71 has inner and outer O-rings 87, 89 for forming a sliding seal between the circumscribing member 55 and the exterior of the downwardly extending body portion 37 of the hanger body 13. Shear means, such as shear pins 91 (FIG. 13) initially fix the position of the anti-preset piston 71 relative to the setting sleeve 49, the shear means being shearable by the application of a predetermined hydraulic pressure to the setting chamber 57 to thereby allow the anti-preset piston 71 to move to the release position shown in FIG. 14.

Returning to FIG. 4, the circumscribing member 55 is connected to an axially slidable tubular portion 93 of a slip setting body 95. The slip setting body 95 circumscribes the downwardly extending body portion 37 of the hanger body 13 and includes an internal groove 97 which contains a support ring 99. The support ring 99 includes a support shoulder 101 which engages the mating shoulder 103 provided on the external diameter of the downwardly extending body portion 37. The slip setting body 95 also includes an internal wicker surface 105 which engages a body lock ring 107. The body lock ring 107 has an external wicker surface which engages the serrated exterior 109 of the hanger body downwardly extending portion 37. The body lock ring 107 allows downward axial movement of the slip setting body 95 relative to the serrated exterior 109 of the hanger body but prohibits upward axial movement thereof. Vent port 111 communicates with the annular space between the hanger body portion 37 and the exterior of the slip setting body 95.

As shown in FIGS. 4–8, the hanger body has a longitudinal passageway 113 for communicating hydraulic pressure to the setting chamber 57. The longitudinal passageway extends from a point below the slip setting body 95 along the longitudinal axis 21 of the hanger body 13 to the setting chamber 57. Preferably, the longitudinal passageway is a gun drilled hole which extends from the lower end of the hanger body to the setting chamber 57.

Figure 5:
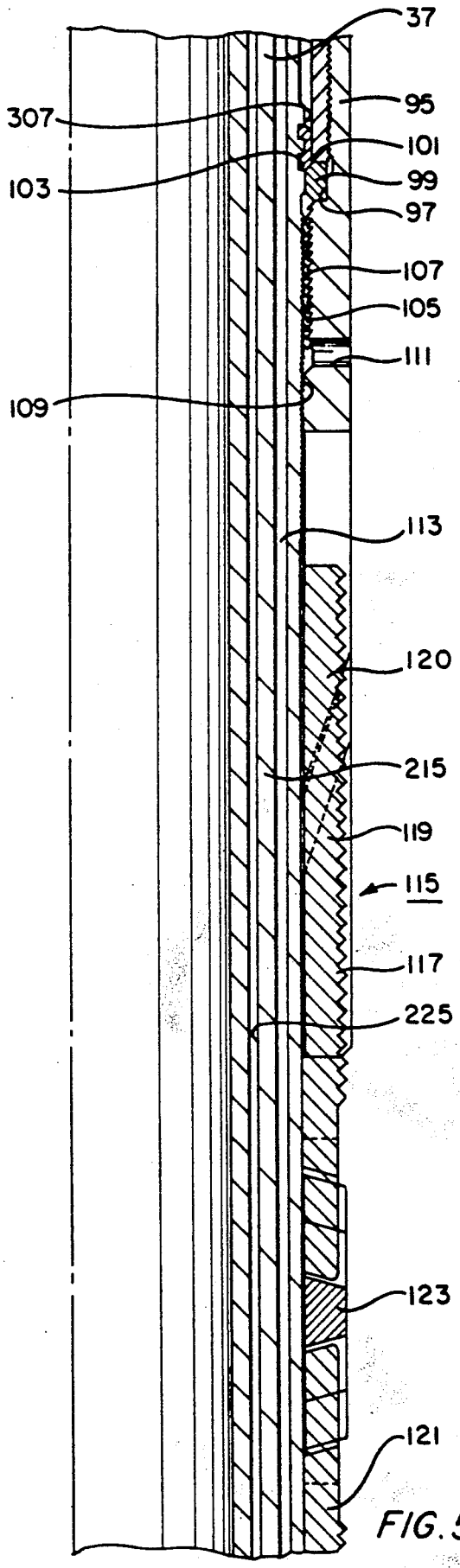
FIG. 5 is a downward continuation of FIG. 4 showing the upper, circumferentially spaced slips carried on the exterior of the hanger body.
Figure 6:
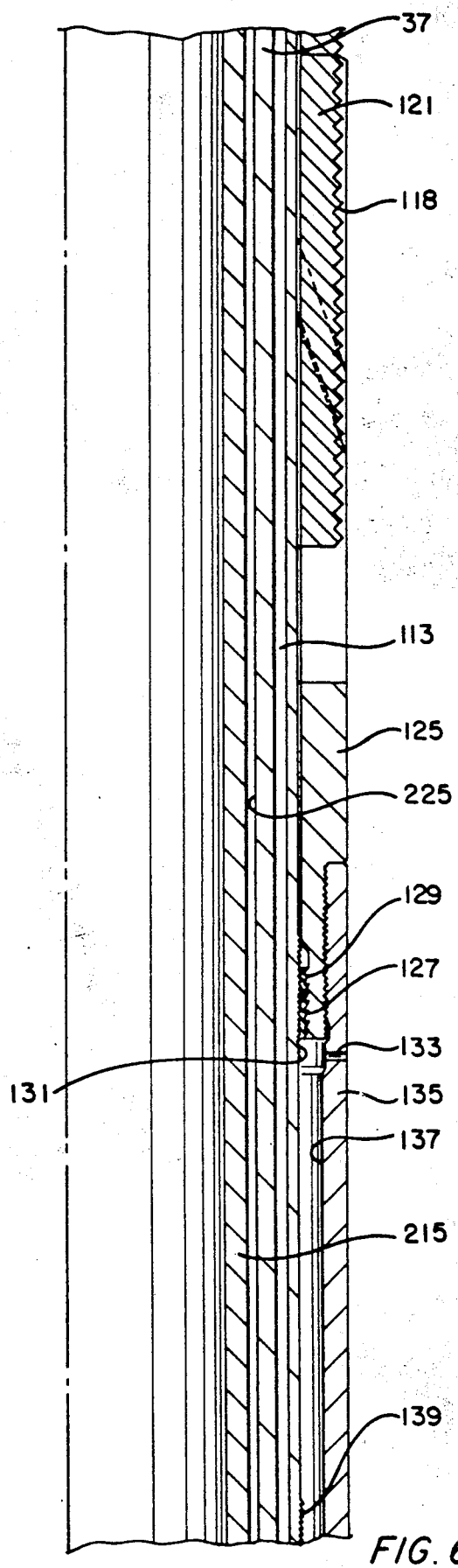
FIG. 6 is a downward continuation of FIG. 5 showing the lower, circumferentially spaced slips carried on the exterior of the hanger body.

As shown in FIGS. 5 and 6, a plurality of circumferentially spaced slips 115 are carried on the exterior of the hanger body 13. The slips have outer gripping surfaces 117 adapted to grip the surrounding well casing. The slips are actuable by axial movement of the anti-preset piston 71 to grip the well casing and support the hanger body 13 within the well casing.

The slip mechanism shown in FIGS. 5 and 6 includes a plurality of circumferentially spaced upper gripping slips 119 which are connected by means of a solid ring 123 with an oppositely arranged set of circumferentially spaced lower slips 121. The particular slip arrangement shown in FIGS. 5 and 6 is described, e.g., in U.S. Pat. No. 4,711,326, issued Dec. 8, 1987, and assigned to the assignee of the present invention, the disclosure of which is hereby incorporated by reference. Such slip gripping mechanisms will be familiar to those skilled in the art and do not form a part of the present invention. Any suitable mechanism can be utilized which allows the gripping slips to move radially outward upon the downward axial movement of the anti-preset piston and slip setting body 95.

The slip setting body includes a lower extent 125 (FIG. 6) which includes an internal wicker surface 127 carrying a body lock ring 129. The body lock ring 129 has an external wicker surface which engages a mating serrated surface 131 provided on the exterior of the downwardly extending body portion 37 of the hanger body 13. The body lock ring 129 allows the lower extent 125 to move downwardly relative to the body portion 37, but prohibits opposite relative movement. A vent portion 133 is provided in the cylindrical sidewall of a circumscribing member 135, the vent port 133 providing communication between an annular space 137 and the exterior of the device. It will also be noted in FIG. 6 that a spaced serrated surface 139 is provided on the exterior of the body portion 37 of the hanger body for engaging the body lock ring 129 during subsequent operations.

Figure 7:
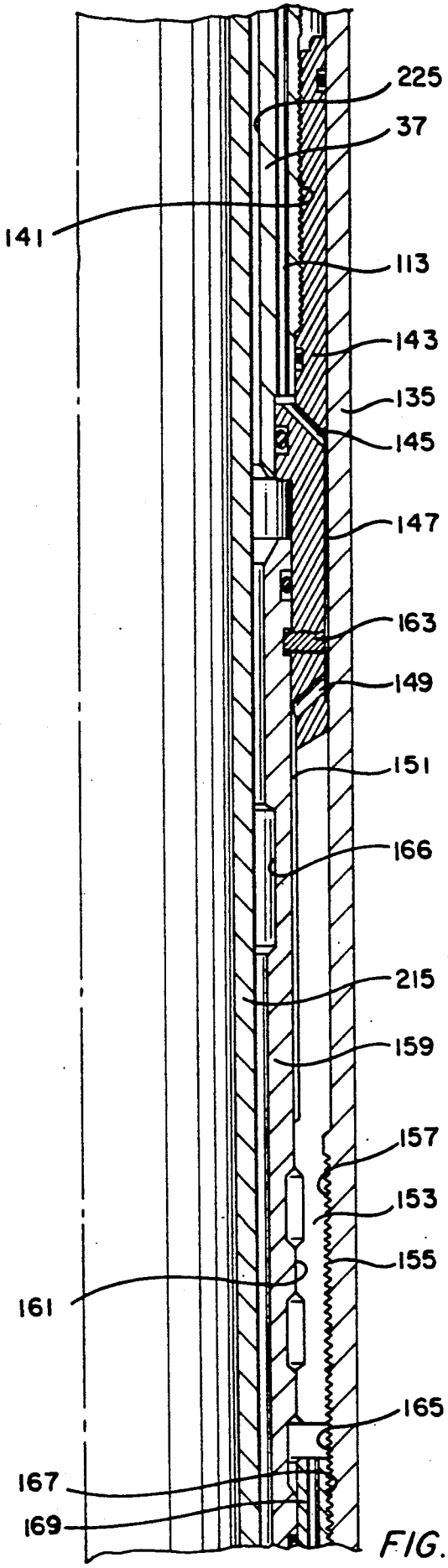
FIG. 7 is a downward continuation of FIG. 6 showing the release sleeve used during the retrieval of the tubing hanger to the well surface.

As shown in FIG. 7, the downwardly extending body portion 37 of the hanger body has an externally threaded surface 141 which engages a hanger body portion 143, the hanger body portion 143 being received within the internal diameter of circumscribing member 135. The hanger body portion 143 includes an angular passage 145 which communicates with the longitudinal passageway 113 and which communicates with an annular region 151 within the circumscribing member 135. The hanger body portion 143 also includes a plurality of downwardly extending collet fingers 153 having external, left-hand threads 155. As shown in FIG. 7, the collet fingers 153 are threadedly engaged with the internally threaded surface 157 of the circumscribing member 135. A release sleeve 159 having locking profile 161 is initially fixed in position beneath the collet fingers 153 to thereby fix the position of the hanger body portion 143 relative to the circumscribing member 135, as by a plurality of shear pins 163. An internal recess 166 within the release sleeve 159 is provided to engage a release tool (not shown) during subsequent release operations for retrieving the tubing hanger to the well surface.

The circumscribing member 135 (FIG. 7) has an internally threaded surface 165 which matingly engages the externally threaded surface 167 of a lower body portion 169 of the hanger body. The lower body portion 169 includes a longitudinal passageway, such as gun drilled hole 171 which extends within the cylindrical sidewall portion thereof and which communicates with the annular region 151.

Figure 8:
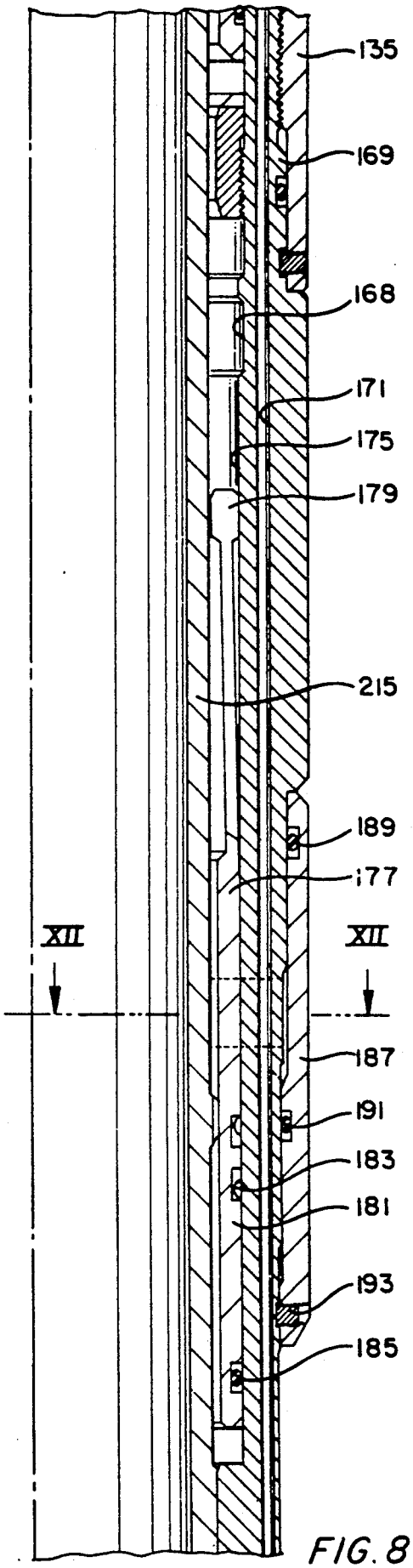
FIG. 8 is a downward continuation of FIG. 7 showing the closing sleeve which opens and closes the flow ports communicating the internal annular flow path to the exterior of the tubing hanger.

As shown in FIG. 8, the lower body portion 169 includes a plurality of circumferentially spaced ports 173 which are located below the packing element 41 and which establish communication between the exterior of the device and an annular flow path 175 within the interior of the device.

An axially slidable closing sleeve 177 is carried within the internal bore of the hanger body. The closing sleeve 177 has an engagement region such as collet lug 179 and has a downwardly depending cylindrical extent 181 which includes axially spaced seal regions formed by O-rings 183, 185 which alternately close the flow ports 173 to the exterior of the tubing hanger and open the flow ports as the closing sleeve 177 moves axially within the interior of the hanger body.

A pump-down sleeve 187 initially circumscribes the lower body portion 169 and has spaced O-ring seals 189, 191 which span the flow ports 173. The pump down sleeve 187 is initially pinned in position by means of a plurality of circumferentially spaced shear-pins 193 which can be severed by the application of a predetermined fluid pressure within the annular flow path 175 to shift the sleeve 187 axially downward and uncover the ports 173.

Figure 9:
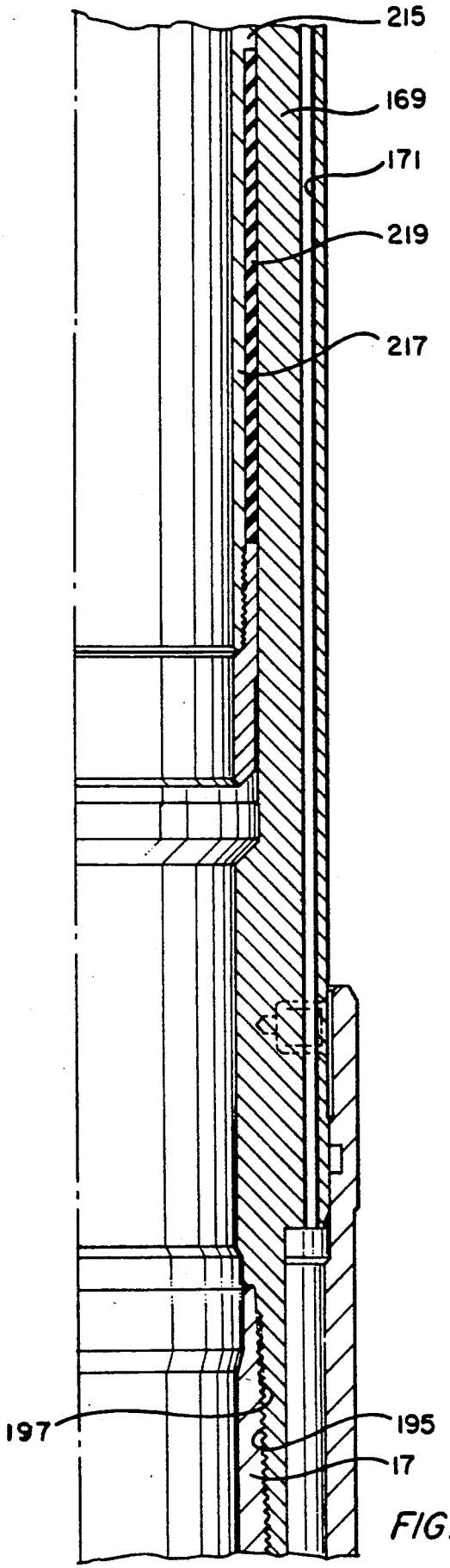
FIGS. 9, 10 and 11 are downward continuations of the tubing hanger showing actuating mechanism used to supply hydraulic pressure to the setting chamber to set the device.
Figure 10:
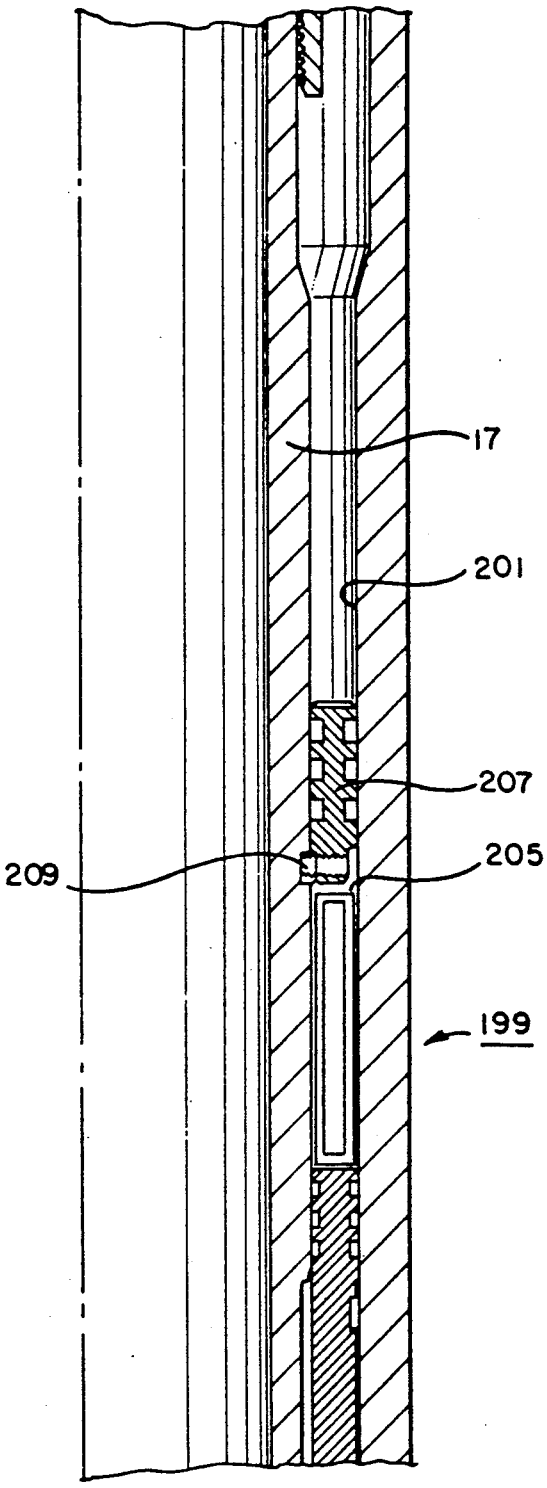

As shown in FIG. 9, the lower body portion 169 has an internally threaded lower extent 195 for matingly engaging the externally threaded upper extent 197 of the tubular sub which makes up the lower end 17 of the hanger body 13. As shown in FIG. 11, the pin end 19 of the lower end 17 is externally threaded to engage a mating connecting end of a production string (not shown) supported by the tubing hanger 11 within the cased well bore. The tubular sub 17, in the embodiment of the device shown in FIGS. 9, 10 and 11, supports an actuating mechanism (199 in FIG. 10) which is used to supply a hydraulic setting force to the oil filled chamber 201 arranged in communication with the longitudinal passageway (171 in FIG. 9). The longitudinal passageway 171 communicates through the annular region 151 (FIG. *7*) and passages 145, 147 and 149 with the longitudinal passageway 113 provided in the downwardly extending body portion 37 of the hanger body. Passageway 113 extends upwardly along the longitudinal axis of the device through the cylindrical sidewall of the hanger body portion and terminates at the setting chamber 57 (FIG. 4) for supplying hydraulic fluid to the setting chamber to set the packing element 41 and slips 115.

The exact actuating mechanism (199 in FIG. 10) illustrated does not form a part of the present invention and is described, for instance, in the co-pending application entitled *Subsurface Well Apparatus,* Ser. No. 07/549,803, filed July 9, 1990, the disclosure of which is hereby incorporated by reference. The actuating control (203 in FIG. 11) generates an activating voltage in response to external conditions, e.g., significant changes in the stresses existing in the conduit walls to which the device is attached. The activating voltage causes the propellant 205 to be actuated, thereby forcing the piston 207 to shear the pins 209 and drive the piston 207 vertically upward to compress the hydraulic oil located in the oil filled chamber 201. This increase in hydraulic pressure is ultimately transmitted to the setting chamber 57, as previously described.

Returning to FIG. 1, the pack-off tubing hanger 11 of the invention also has a Concentric Tubing Anchor (CTA) located within the internal bore 25 of the hanger body 13. As will be described, the CTA has an external latch profile, designated generally as 213 in FIG. 2, which is adapted to be engaged within the internal thread profile 31 of the hanger body 13. In addition to the upper extent which carries the external latch profile 213, the CTA also has a lower, tubular extent 215 which extends downwardly along the longitudinal axis 21 of the device from the upper end of the hanger body to the lower body portion 169 (FIG. 9). The lower most extent 217 (FIG. 9) of the CTA includes an external seal region 219 which slidingly engages the internal diameter of the lower body portion 169.

As shown in FIG. 1, the CTA has an outer tubular body 221 and a concentrically spaced inner tubular body 223 at the upper extent thereof. The CTA is used to connect the tubing string leading from the well surface (not shown) to the tubing hanger 11. The concentric spacing of the inner and outer tubular bodies 221, 223 defines an annular flow path 225 which runs the length of the CTA from the upper extent thereof to the ports (173 in FIG. 8) whereby a fluid such as natural gas can be injected along the annular flow path from a point above the set packing element 41 and out the ports 173 to the annular space in the surrounding borehole below the set packing element. As will be familiar to those skilled in the art, a pair of safety valves are customarily located above the device (not shown). A tubing safety valve seals off the production and internal tubing while an annular safety valve is used to seal off fluid which is injected down the annular flow path 225. As a result, the tubular bodies 221, 223 are fixed relative to one another in the position shown in FIG. 1 and do not move relative to one another when the CTA is installed within the surrounding hanger body 13.

Figure 2:
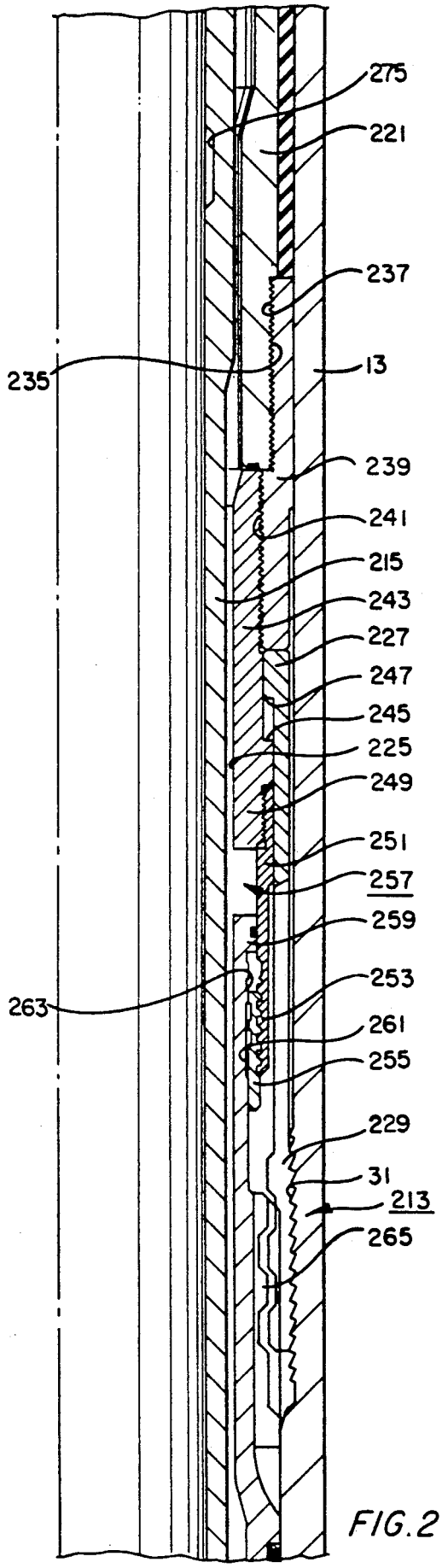
FIG. 2 is a downward continuation of FIG. 1 showing the external latch profile of the tubing anchor and the internal thread profile of the anchor body.

As shown in FIGS. 1 and 2, the CTA preferably includes a downwardly extending latch collet 227 having a plurality of downwardly extending collet fingers 229. As shown in FIG. 2, the collet fingers 229 have external left-hand threads which engage the internal thread profile 31 of the hanger body 13, whereby the CTA can be released from the surrounding hanger body 13 by right-hand rotation of the tubing string leading to the well surface.

The outer tubular body 221 (FIG. 1) carries an outer threaded ring 231 which is used to locate the CTA within the hanger body and has an upper annular seal region 233 which passes circumferentially about the external diameter of the outer tubular body 221. The lower extent of the outer tubular body 221 also has an externally threaded region 235 which engages the mating internally threaded region 237 of a connecting member 239. The connecting member 239 has an internally threaded lower extent 241 which matingly engages a downwardly extending member 243, the member 243 having a stepped external diameter which forms a shoulder 245 for contacting a mating internal shoulder 247 provided on the latch collet upper end 227.

The downwardly extending member 243 has an externally threaded lower extent 249 which engages a mating lock ring 251. The lock ring 251 has an internal locking profile 253 for engaging the mating external surface of a body lock ring 255.

As seen in FIG. 2, the downwardly extending member 243 is adapted to engage an upwardly extending portion of a latch retainer 259 at a clutch area 257. The clutch area constitutes a rotational clutch which allows the latch retainer 259 to move axially with respect to the downwardly extending member 243, while at the same time allowing the member 243 to supply rotational torque to the latch retainer 259. It should also be noted that the body lock ring 255 has an internal lock profile 261 adapted to matingly engage the external profile 263 provided on the outer diameter of the latch retainer 259. The mating profiles 261, 263 allow the latch retainer 259 to move downwardly with respect to the body lock ring 255, but thereafter prohibits upward relative movement between the two parts.

As will be explained, the latch retainer portion 259 of the inner tubular body includes alternating external support lands 265 which underlie the externally threaded collet fingers 229 in the latched position and which are axially shiftable from beneath the externally threaded collet fingers in a release position to allow retrieval of the CTA from the internal bore of the surrounding hanger body 13.

As shown in FIG. 1, the inner tubular body 223 has a cylindrical fixed portion 267 and an axially aligned, actuating portion 269. The actuating portion 269 is also a cylindrical member which forms the bottom portion of the cylindrical fixed portion 267 in the fixed position shown in FIG. 1. The fixed portion 267 and actuating portion 269 are initially connected by means of a severable joint 271 which can be, e.g., a welded connection with is severable upon the application of a predetermined tension load between the fixed portion 267 and the actuating portion 269 of the inner tubular body 223. As will be explained more fully, the actuating portion is axially shiftable to move the external latch profile (265 in FIG. 2) to the release position to actuate the release of the CTA from within the hanger body 13. The tension load can be supplied between the fixed portion 267 and actuating portion 269 in a number of fashions. For instance, a conventional wireline release tool (not shown) can be lowered within the interior of the inner tubular body 223 to engage the upper recess 273 and lower recess 275 shown in FIG. 1 and 2. The release tool would then be actuated from the well surface to cause relative downward movement of the actuating portion 269 relative to the fixed portion 267 to sever the welded connection 271.

The outer tubular body 221 of the CTA can also be provided with stop means on the exterior of the outer tubular body 221 for initially preventing downward movement of the outer tubular body 221 relative to the hanger body 13 and for preventing the externally threaded collet fingers 229 from engaging the internally threaded profile 31 provided in the internal bore of the hanger body 13, as during recompletion operations.

Figure 18:
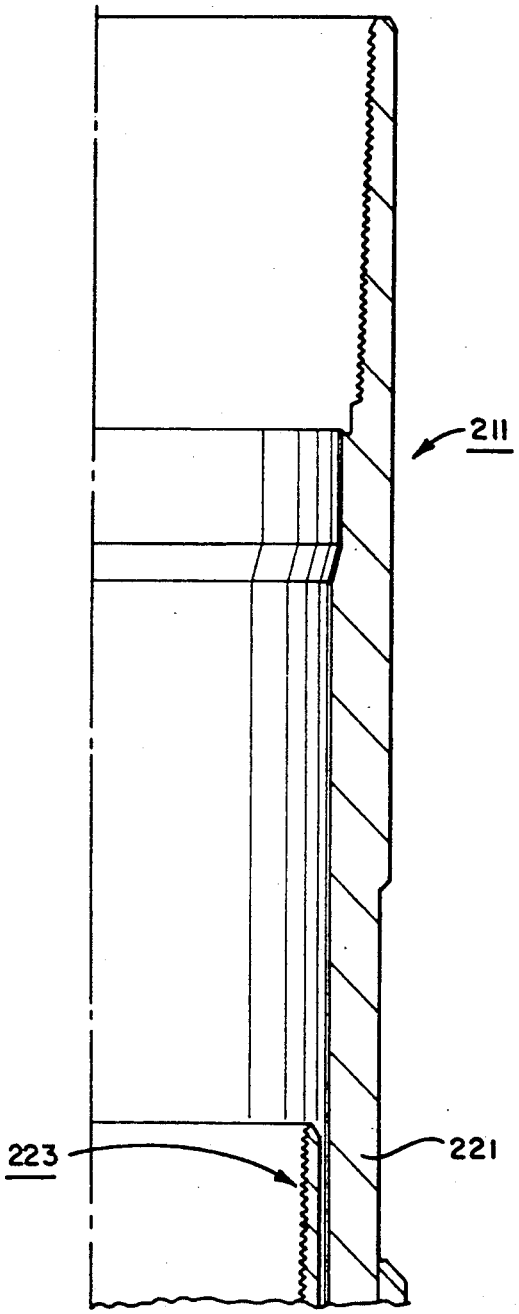
FIGS. 18, 19, 20 and 21 are quarter-sectional views similar to FIGS. 1-2 which show the concentric tubing anchor in the spaced-out, running-in position.
Figure 19:
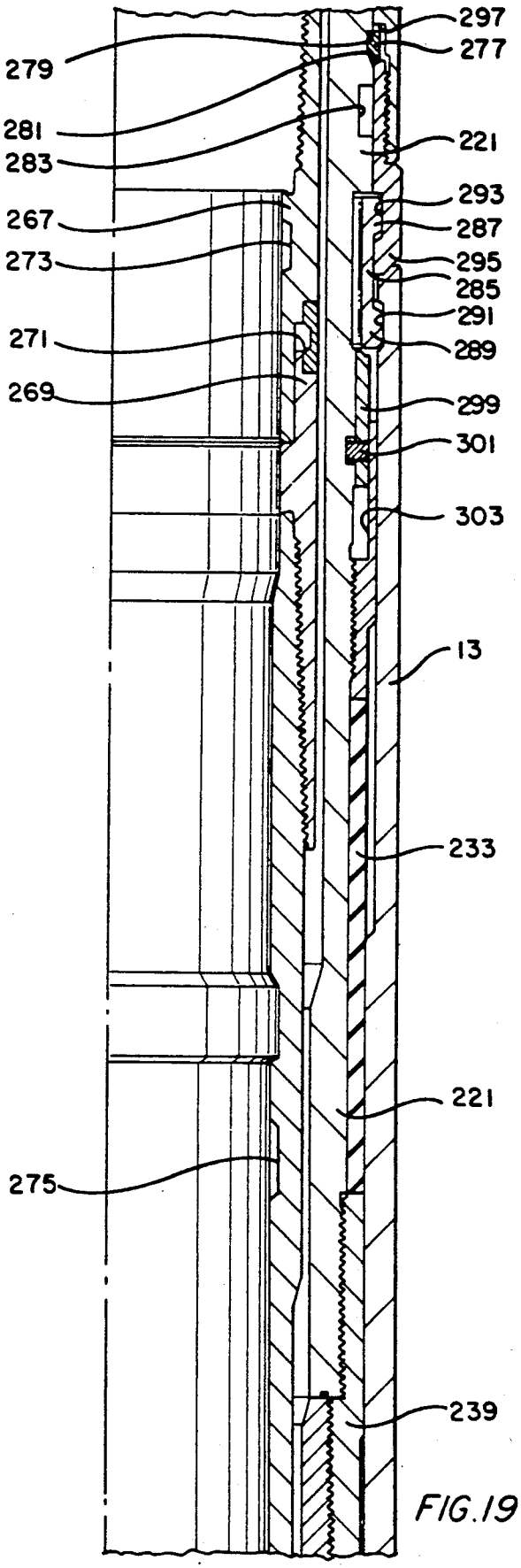
Figure 20:
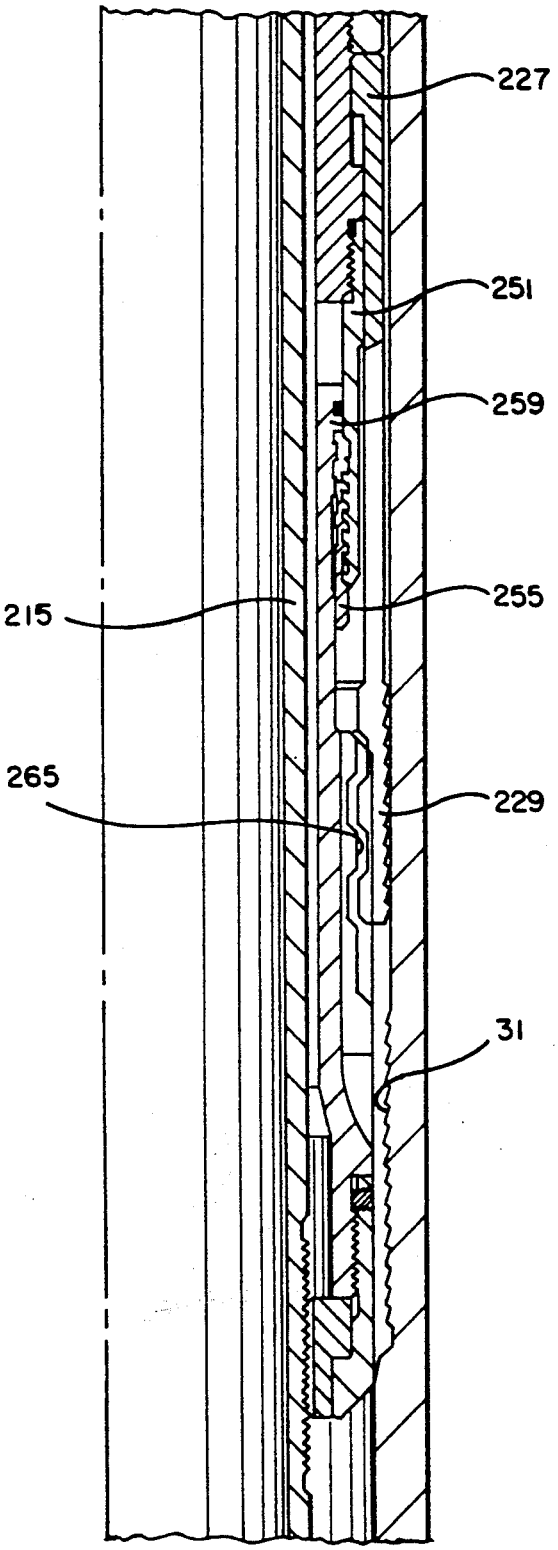
Figure 21:
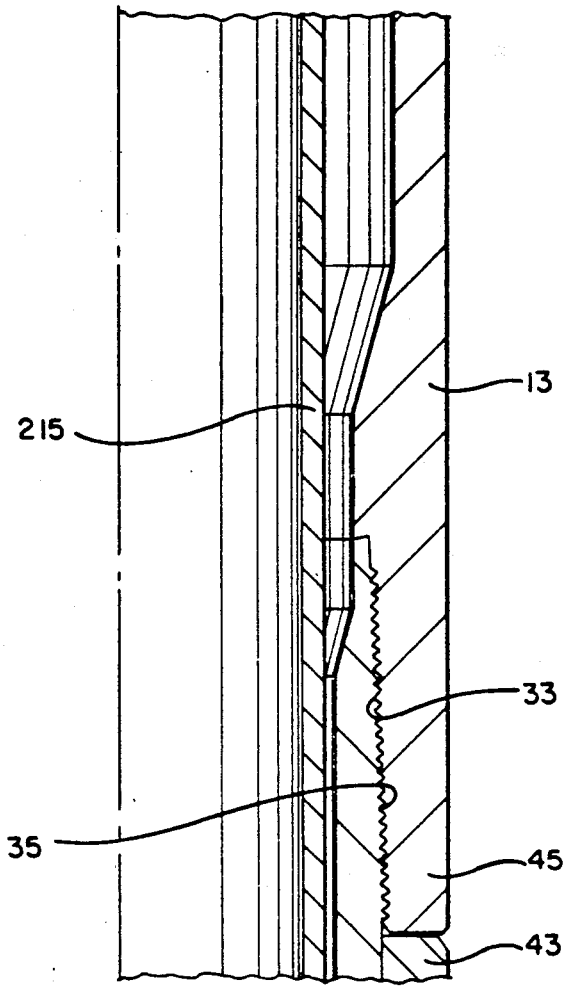
Figure 22:
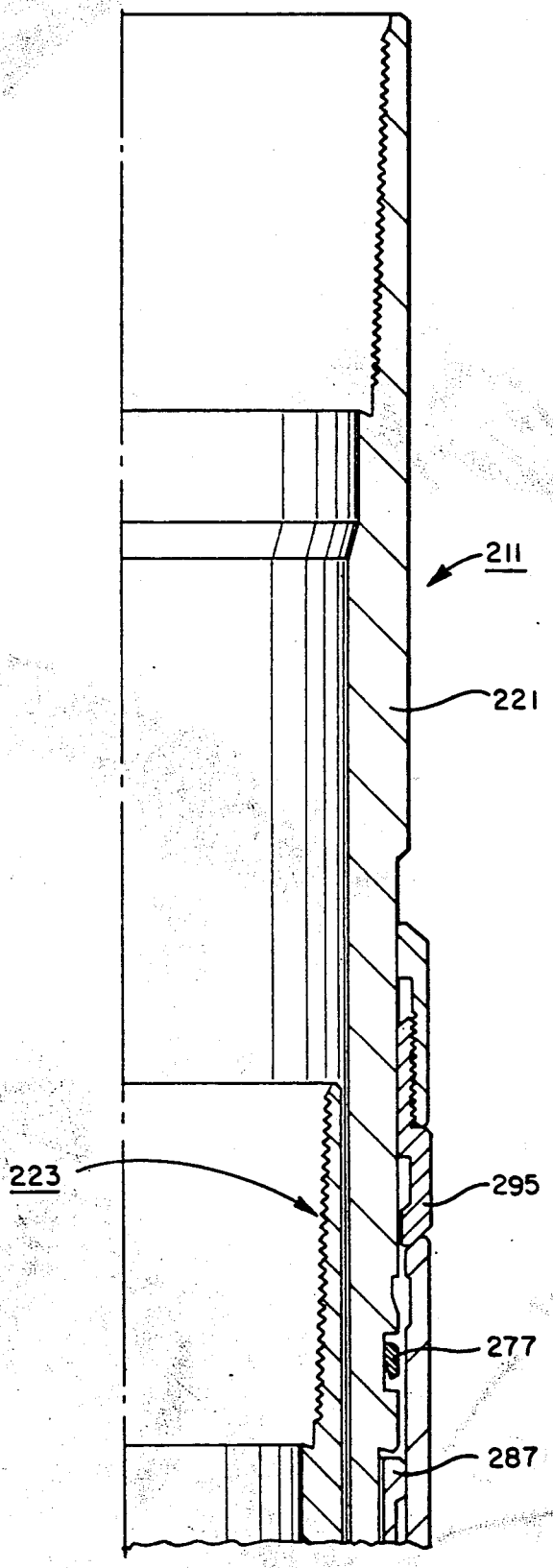
FIGS. 22, 23, 24 and 25 show the concentric tubing anchor in the release position which allows the anchor to be retrieved to the well surface.
Figure 23:
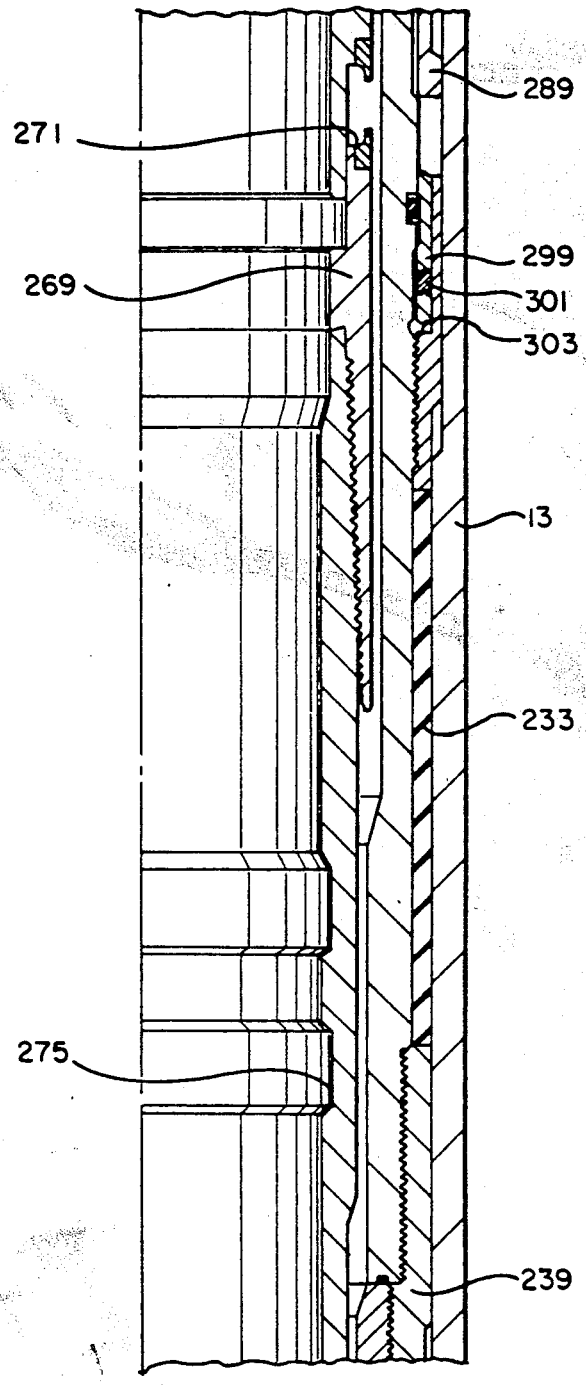
Figure 24:
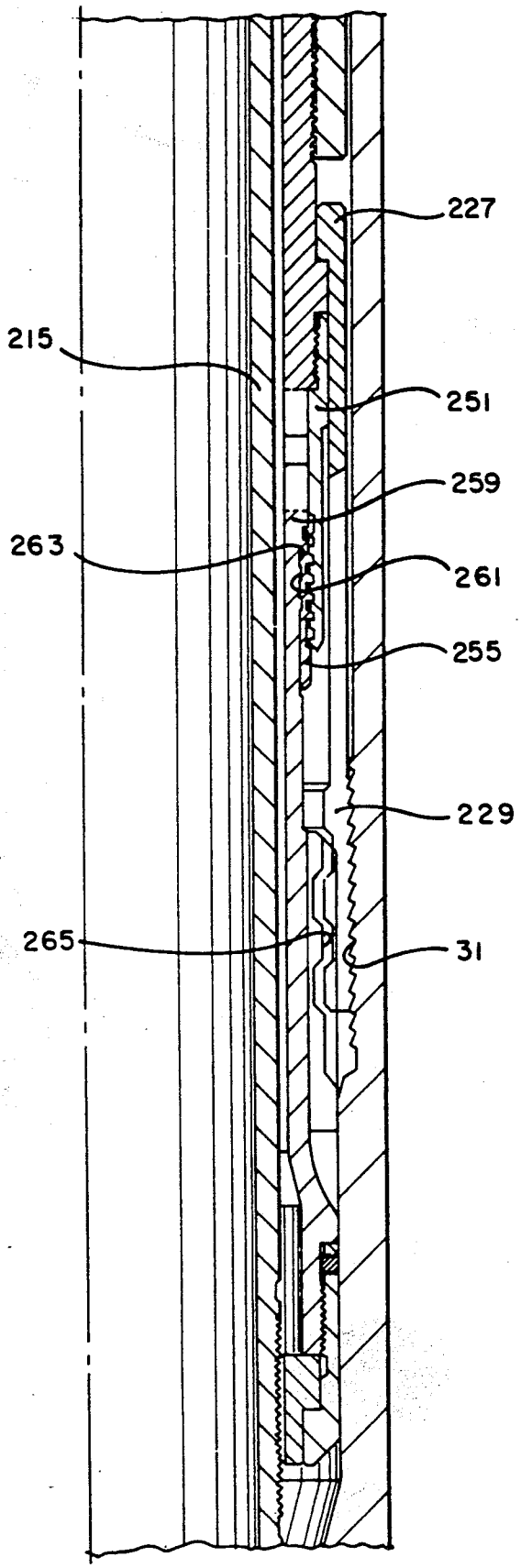
Figure 25:
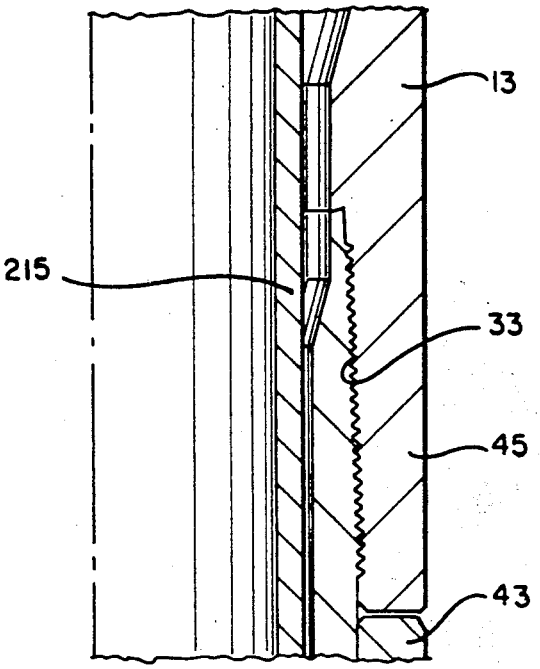

FIGS. 18 and 19 show the CTA in a spaced-out position, as would occur during recompletion upon initially locating the CTA within the bore of the previously set tubing hanger. The stop means includes a stop ring 277 located in a recess 279 provided on the exterior of the outer tubular body 221. The recess 279 also includes a ramp region 281 which allows downward movement of the stop ring 277 as the outer tubular body 221 is moved upwardly within the surrounding hanger body 13 but which initially prohibits downward movement of the outer tubular body 221 within the surrounding hanger body 13.

An indexing groove 283 is located axially below the recess 279 on the exterior of the outer tubular body 221 for receiving the stop ring 277 after the stop ring passes over the ramp region 281. The depth of the indexing groove 283 is slightly greater than the depth of the recess 279 whereby movement of the stop ring 277 to the indexing groove 283 causes the stop ring 277 to move from a greater relative radial position to a lesser relative radial position.

Connecting means are also located on the exterior of the outer tubular body 221 for initially connecting the CTA to the surrounding hanger body 13, in the position shown in FIGS. 18-21.

As shown in FIG. 19, the preferred connecting means includes a double lobed C-ring 285 having oppositely arranged lobes 287, 289 which extend radially outward from the exterior of the outer tubular body 221. The lower lobe 289 is adapted to engage a mating groove 291 provided within the internal bore of the hanger body. The upper lobe 287 is engaged within an internal recess 293 of a triggering ring 295 provided on the exterior of the outer tubular body 221. The triggering ring 295 has an internal shoulder 297 which is adapted to engage the stop ring 277 for moving the stop ring up the ramp region 281. As previously discussed, the depth of the indexing groove 283 is selected to remove the stop ring 277 from contact with the internal shoulder 297 of the triggering ring 295 to allow the CTA to move downward relative to the hanger body 13 to thereby latch the latch collet 227 within the mating internal thread profile 31 provided within the internal bore of the surrounding hanger body 13.

Shear release means, such as collar 299 are located below the C-ring 285 for maintaining the C-ring in the position shown in FIG. 19 until the CTA is moved upwardly relative to the surrounding hanger body. Upper movement of the CTA shears the shear-pins 301 and allow downward movement of the collar 299 within the annular space 303, as will be more fully described in the operational description of the invention.

The operation of the device of the invention will now be described. In the case of an initial completion operation, the pack-off tubing hanger 11 is run into position within the surrounding well casing with the packing element 41 and gripping slips 115 in the relaxed positions shown in FIGS. 1-5. The CTA, which is received within the internal bore 25 of the hanger body 13, would be in the position shown in FIGS. 1-2. Note that the CTA is supported within the hanger body 13 with the externally threaded fingers 229 of the latch collet 227 engaged with the mating internal thread profile 31 provided in the hanger body.

The combined CTA and hanger are lowered to the desired setting depth and the actuating control (203 in FIG. 11) is actuated to cause the actuating mechanism to sever pins 209 and force the piston 207 axially upward, thereby compressing the oil contained within the oil filled chamber 201. Hydraulic pressure is thus supplied through the longitudinal passageway 171 (FIG. 9) to the annular region 151 (FIG. 7) and through the passageways 145, 147, 149 to the longitudinal passageway 113. The longitudinal passageway 113 continues upwardly through the downwardly extending body portion 37 of the hanger body and terminates at the setting chamber 57 (FIG. 4).

As best shown in FIGS. 13-17, an increase in hydraulic pressure in the setting chamber 57 acts upon the anti-preset piston 71 causing the piston 71 to shear the pins 91 and move downwardly. This action causes the upwardly extending fingers 79 to be pulled from beneath the snap ring 83, thereby allowing the snap ring 83 to move radially inward within the groove 81 to the release position shown in FIG. 14. In this position, the snap ring 83 no longer engages the internal shoulder 85, whereby the setting sleeve 49 is freed to move in an upward axial direction to compress the packing element 41. Body lock ring 69 (FIG. 4) prohibits the opposite axial travel of the setting sleeve 51 relative to the circumscribing member 55 and locks the setting force in the packing element.

The downward movement of the anti-preset piston 71 and the opposite relative movement between the circumscribing member 55 and the setting sleeve 49 also causes the slip setting body 95 to move downwardly to effect the outward radial movement of the gripping slips 119, 121. During the setting operation, the upper slips 119 and ring 123 cause the lower slips 121 to move axially downward as a unit, whereby the lower slips 121 ride up their respective ramp surfaces. This causes the gripping surfaces 118 to travel radially outward and grip the surrounding well casing. After the lower slips 121 begin to grip the surrounding casing, upper slips 119 are driven up the ramp surface 120, thereby causing outward radial movement of the upper slips to grip the surrounding casing. The exact setting mechanism of the gripping slips will be familiar to those skilled in the art and is described, for instance, in U.S. Pat. No. 4,711,326, previously referenced.

Movement of the top body lock ring 69 traps the packing element in compression and maintains a fluid tight seal. Movement of the middle body lock ring 107 along the serrated exterior 109 of the hanger body portion 37 causes the lock ring to act as a one-way ratchet device which prevents the hanger load from being transferred into the packing element after setting the device. The bottom body lock ring 129 similarly ratchets along the mating serrated surface 131 to maintain the slips in a retracted position during retrieval.

The tubing hanger-CTA can be assembled at the surface in the configuration shown in FIGS. 1-2, run into the well bore as a unit and set at the desired depth within the casing. This would be the typical arrangement for long term production from the well. The CTA can be released from within the internal bore of the hanger body 13 by lowering a wireline release tool (not shown) which engages the upper and lower recesses 273, 275 for applying a tension load between the fixed portion 267 and actuating portion 269 of the CTA. The application of a predetermined tension load causes the welded connection 271 to sever, thereby allowing the actuating portion 269 to move vertically downward as viewed in FIGS. 1 and 2. FIGS. 22–25 show the CTA in the release position in which the welded connection 271 has been severed and the actuating portion 269 has shifted downwardly. This action causes the alternating support lands 265 of the latch retainer 259 to move slightly downward from beneath the externally threaded collet fingers 229, whereby the external threaded can be freed from the thread profile 31 located within the bore of the hanger body. The body lock ring 255 moves along the external profile 263 of the latch retainer 259 to thereby lock the latch profile 265 in the position shown in FIG. 24 so that the CTA can be retrieved to the well surface.

In the case of a recompletion operation, the CTA would be reinserted within the internal bore 25 of the previously set hanger body 13. The CTA would be dressed at the surface so that the stop ring 277 is in the recess 279 and the shear pins 301 are supporting the collar 285. The CTA would then be run downhole and inserted within the internal bore 25 of the tubing hanger body 13. FIGS. 18–21 show the CTA during this "locating" operation. Note that the lobe 289 of the collar 285 has engaged the mating groove 291 in the hanger body 13. The collet latch fingers 229 do not engage the internal thread profile 31 of the hanger body, however. The operator at the well surface would then "mark" the tubing string in order to determine the length of pipe needed to extend from the surface to the tubing hanger. The tubing string extending from the CTA to the well surface can now be lifted vertically upward. This action causes the shear-pins 301 to sever, freeing the collar 299 (FIG. 19) and allowing relative movement between the outer tubular body 21 of the CTA and the hanger body 13. As the outer tubular body 221 moves vertically upward, the stop ring 277 rides up the ramp 281 and is received within the indexing groove 283. This allows the tubing string to be lifted several feet or more so that, e.g., the length of the tubing string can be adjusted by adding or removing a spacing sub in the tubing string.

The CTA can then again be lowered into the well bore and be reinserted within the surrounding hanger body 13 and moved to the latched position shown in FIGS. 1 and 2 of the drawings. In the latched position, the latch collet 227 is engaged with the internal thread profile 31 of the hanger body 13, the stop ring 277 is located within the indexing groove and the C-ring 285 no longer engages the upper end 15 or triggering ring 295. Approximately ⅜ inch play exists in the latch mechanism, as illustrated at 245 in FIG. 2, so that placing the tubing string under tension causes the latch profile 265 to move underneath the externally threaded fingers 229 of the collet latch to maintain the latched position. It will also be noted in FIG. 19 that the cylindrical fixed portion 267 of the CTA is firmly connected to the actuating portion 269 and that the severable connection 271 is whole.

In order to release the tubing hanger, a suitable retrieving tool (not shown) is lowered into the internal bore 25 of the hanger body 13 from the well surface. It will be understood, at this point, that the CTA has now been retrieved to the well surface and that only open casing exists above the tubing hanger. Thus, with reference to FIG. 7 and 8, it will be understood that the lower tubular extent 215 of the CTA has now been retrieved to the well surface.

The retrieving tool can be of conventional design and is not described in detail since it does not form a part of the present invention. Since the retrieving tool will be required to support the weight of the tubing hanger and associated production string depending from the hanger body, it will typically be run on drill string from the well surface down the borehole. The retrieving tool will be designed to engage the release grooves 166, 168, shown in FIGS. 7 and 8.

The release tool will be actuated from the well surface, as by supplying hydraulic pressure through the interior of the drill pipe string to cause the release sleeve 159 (FIG. 7) to move upwardly relative to the hanger body portion 143. This action causes the shearpins 163 to sever and causes the locking profile 161 to be moved upwardly from beneath the collet fingers 153 of the hanger body portion 143. Freeing the collet fingers 153 disengages the threaded surfaces 155, 157, allowing opposite relative movement between the downwardly extending body portion 37 of the hanger body and the circumscribing member 135, as viewed in FIG. 7.

As this action is occurring, the first pick up shoulder (305 in FIG. 4) engages the setting sleeve 49, stretching out the sleeve portion thereof. A second pick up shoulder (307 in FIG. 5) engages the internal shoulder (309 in FIG. 4) of the tubular portion 93 causing the upper cone 120 to be pulled from beneath the upper slips 119. This action allows the upper slips 119 and, in turn, lower slips 121 to relax and be retracted radially inward so that the unit is stretched from the top to release the setting mechanism. As shown in FIG. 6, the internal wicker surface 127 of the body lock ring 129 engages the spaced serrated surface 139 of the body portion 37 as the body portion moves upwardly relative to the lower extent 125 to lock the setting components in the stretched-out position. The hanger can be retrieved on the drill pipe string to the well surface.

An invention has been provided with several advantages. The pack-off tubing hanger of the invention is extremely sturdy in design and can withstand extremely high axial loads. It is especially useful when set at shallow depths and subjected to temperature variations such as are encountered during gas injection operations. The packing element and slips are set by means of a hydraulic passageway which runs from the lower extent of the device to the upper extent thereof. This setting arrangement provides great versatility in allowing a number of alternative setting mechanisms to be utilized to provide the needed hydraulic force. The novel anti-preset piston and setting sleeve for the packing element securely engage the setting sleeve during the running-in operation so that the packing element cannot be inadvertently set if parts of the device should drag on the surrounding casing. The companion CTA can be engaged with the tubing hanger to allow the overall device to be hung in a one-trip operation.

The unique stop means and indexing ring carried on the CTA are especially useful in the case of recompletion operations. After locating the CTA with respect to the previously set tubing hanger, the CTA and tubing string can be lifted to allow the length of the tubing string to be adjusted. When the CTA is again inserted within the bore of the hanger body, the stop means and indexing ring are shifted in position to allow the engagement of the CTA latch collet within the hanger bore.

The CTA can be released from within the latched position by using a suitable wireline retrieving tool or can be released by right-hand rotation of the unit from the surface which frees the left-hand threads of the collet latch. The hanger can be released and retrieved to the well surface by running a retrieving tool on a drill string which shifts a release sleeve in the lower portion of the hanger body to stretch-out the slip and packing element setting mechanisms from the top to relax these elements and allow the device to be retrieved to the well surface.

While the invention has been shown in only one of its forms, it is not thus limited but is susceptible to various changes and modifications without departing from the spirit thereof.

I claim:

1. A pack-off apparatus for sealing between concentric tubular bodies in a subsurface well location, comprising:

a generally cylindrical hanger body having an upper end and a lower end, the hanger body being adapted to be supported in a surrounding well casing, the hanger body having a longitudinal axis, cylindrical sidewall portions and an internal bore;

an annular packing element carried about the hanger body which is radially expandable under axial compression;

a setting sleeve carried about the hanger body, the setting sleeve being axially movable with respect to the packing element for compressing the packing element, the setting sleeve having an upper end adapted to contact the packing element and a lower end, the lower end of the setting sleeve being slidably received within the interior of a circumscribing member which defines a setting chamber on the exterior of the hanger body;

an anti-preset piston carried about the hanger body below the setting sleeve, the anti-preset piston having an engagement end which initially locks the setting sleeve in a running-in position, the anti-preset piston being axially movable in an opposite direction from the setting sleeve to release the setting sleeve and set the packing element upon the application of hydraulic pressure to the setting chamber;

a plurality of circumferentially spaced slips carried on the exterior of the hanger body, the slips having outer gripping surfaces adapted to grip the surrounding well casing, the slips being actuable by axial movement of the anti-preset piston to grip the well casing and support the hanger body within the well casing; and wherein the hanger body has a longitudinal passageway for communicating hydraulic pressure to the setting chamber, the longitudinal passageway extending from a point below the circumferentially spaced slips along the longitudinal axis of the hanger body to the setting chamber.

2. The pack-off apparatus of claim 1, wherein the longitudinal passageway is a gun drilled hole which extends from the lower end of the hanger body to a point intermediate the gripping slips and the packing element.

3. The pack-off apparatus of claim 1, wherein the setting sleeve lower end has a plurality of downwardly extending fingers which define circumferentially spaced end slots between each finger, the engagement end of the anti-preset piston being provided with upwardly extending fingers which are received within the setting sleeve end slots when the setting sleeve is locked in the running-in position, setting sleeve fingers having a circumferential groove cut therein which contains a snap ring, the circumscribing member having an internal shoulder which engages the snap ring when the engagement end of the anti-preset piston locks the setting sleeve in the running-in position.

4. The pack-off apparatus of claim 3, wherein the upwardly extending fingers of the anti-preset piston initially underlie the snap ring of the setting sleeve when in the running-in position whereby the snap ring engages the internal shoulder of the circumscribing member, and wherein the upwardly extending fingers are axially movable from beneath the snap ring to a release position which frees the snap ring from the internal shoulder upon the application of hydraulic pressure to the setting chamber.

5. The pack-off apparatus of claim 4, further comprising shear means initially fixing the position of the anti-preset piston relative to the setting sleeve, the shear means being shearable by the application of a predetermined hydraulic pressure to the setting chamber to thereby allow the anti-preset piston to move to the release position.

6. A pack-off, tubing hanger for use in a tubing string extending from a well surface location to a downhole location within a surrounding subterranean formation lined with a well casing, the tubing hanger comprising:

a generally cylindrical hanger body having an upper end and a lower end, the hanger body being adapted to be supported in the surrounding well casing, the hanger body having a longitudinal axis, cylindrical sidewall portions and an internal bore, the hanger body also being provided with an internal thread profile for mating engaging a tubing anchor received within the internal bore;

a concentric tubing anchor located within the internal bore of the hanger body, the tubing anchor having an external latch profile adapted to be engaged with the internal thread profile of the hanger body;

an annular packing element carried about the hanger body which is radially expandable under axial compression;

a setting sleeve carried about the hanger body, the setting sleeve being axially movable with respect to the packing element for compressing the packing element, the setting sleeve having an upper end adapted to contact the packing element and a lower end, the lower end of the setting sleeve being slidably received within the interior of a circumscribing member which defines a setting chamber on the exterior of the hanger body;

an anti-preset piston carried about the hanger body below the setting sleeve, the anti-preset piston having an engagement end which initially locks the setting sleeve in a running-in position, the anti-preset piston being axially movable in an opposite direction from the setting sleeve to release the setting sleeve and set the packing element upon the application of hydraulic pressure to the setting chamber;

a plurality of circumferentially spaced gripping slips carried on the exterior of the hanger body, the slips having outer gripping surfaces adapted to grip the surrounding well casing, the slips being actuable by axial movement of the anti-preset piston to grip the well casing and support the hanger body within the well casing; and wherein the hanger body has a longitudinal passageway for communicating hydraulic pressure to the setting chamber, the longitudinal passageway extending from a point below the circumferentially spaced slips along the longitudinal axis of the hanger body to the setting chamber.

7. The pack-off tubing hanger of claim 6, wherein the concentric tubing anchor has an upper extent which carries a latch assembly for engaging the mating thread profile of the interior of the hanger body and a lower, tubular extent which extends within the interior of the hanger body to a point below the gripping slips.

8. The pack-off tubing hanger of claim 7, wherein the concentric tubing anchor has upper and lower seal regions, which are located above and below the packing element within the interior of the hanger body when the latch assembly engages the interior of the hanger body.

9. The pack-off tubing hanger of claim 8, wherein the concentric tubing anchor has an outer tubing body and a concentric inner tubing body at the upper extent thereof, the outer and inner tubular bodies defining an annular flow path which extends from the upper extent of the concentric tubing anchor to the lower extent thereof.

10. The pack-off tubing hanger of claim 9, wherein flow ports are located in the hanger body below the packing element, the flow ports being arranged in communication with the annular flow path defined by the inner and outer concentric tubular bodies of the concentric tubing anchor, whereby fluid pumped down the annular flow path passes to the exterior of the pack-off tubing hanger to an annular area of the borehole located below the packing element when the packing element is set in engagement with the surrounding well casing.

11. The pack-off tubing hanger of claim 10, further comprising an axially slidable closing sleeve carried within the internal bore of the hanger body, the closing sleeve having an engagement region which is engageable by the tubular portion of the concentric tubing anchor as the concentric tubing anchor is inserted and withdrawn from the internal bore of the hanger body, the closing sleeve having axially spaced seal regions which alternately close the flow ports to the exterior of the tubing hanger as the concentric tubing anchor is withdrawn and open the flow ports as the concentric tubing anchor is inserted within the internal bore of the tubing hanger.

12. The pack-off, tubing hanger of claim 11, wherein the longitudinal passageway in the hanger body is a gun drilled hole which extends from the lower end of the hanger body to a point intermediate the gripping slips and the packing element.

13. The pack-off tubing hanger of claim 12, wherein the setting sleeve lower end has a plurality of downwardly extending fingers which define circumferentially spaced end slots between each finger, the engagement end of the anti-preset piston being provided with upwardly extending fingers which are received within the setting sleeve end slots when the setting sleeve is locked in the running-in position, setting sleeve fingers having a circumferential groove cut therein which contains a snap ring, the circumscribing member having an internal shoulder which engages the snap ring when the engagement end of the anti-preset piston locks the setting sleeve in the running-in position.

14. The pack-off tubing hanger of claim 13, wherein the upwardly extending fingers of the anti-preset piston initially underlie the snap ring of the setting sleeve when in the running-in position whereby the snap ring engages the internal shoulder of the circumscribing member, and wherein the upwardly extending fingers are axially movable from beneath the snap ring to a release position which frees the snap ring from the internal shoulder upon the application of hydraulic pressure to the setting chamber, thereby releasing the setting sleeve and setting the packing element.

15. An improved concentric tubing anchor of the type having an outer tubular body and a concentrically spaced inner tubular body at an upper extent thereof, the upper extent also having an external latch profile adapted to be engaged with an internal profile provided within an internal bore of a surrounding hanger body, the concentric tubing anchor also having a lower, tubular extent which extends downwardly within the interior of the hanger body, the improvement comprising:

a downwardly extending latch collet supported on the outer tubular body, the latch collet having a plurality of externally threaded collet fingers which are adapted to matingly engage an internal thread profile provided in the internal bore of the surrounding hanger body to thereby latch the concentric tubing anchor in a latched position within the hanger body;

wherein the inner tubular body has a plurality of external support lands which underlie the externally threaded collet fingers in the latched position and which are axially shiftable from beneath the externally threaded collet fingers in a release position; and wherein the inner tubular body has a cylindrical fixed portion and an axially aligned, actuating portion which is axially shiftable to move the external support lands to the release position and actuate the release of the concentric tubing anchor from within the hanger body;

wherein the inner tubular body is initially connected to the axially aligned, actuating portion by a severable joint.

16. The improved concentric tubing anchor of claim 15, wherein the severable joint is a welded connection which is severable upon the application of a predetermined tension load between the fixed portion and actuating portion of the inner tubular body.

17. The improved concentric tubing anchor of claim 15, further comprising ratchet means located between the exterior of the inner tubular body and the interior of the outer tubular body for locking the alternating external support lands in the release position.

18. The improved concentric tubing anchor of claim 17, wherein the ratchet means includes a rotational clutch for transmitting rotational torque to the externally threaded collet fingers for releasing the latch collet from the internal thread profile upon rotation of the concentric tubing anchor within the surrounding hanger body.

19. An improved latch assembly of the type having an outer tubular body and a concentrically spaced inner tubular body at an upper extent thereof, the upper extent also having an external latch profile adapted to be engaged with an internal profile provided within an internal bore of a surrounding hanger body, the latch assembly also having a lower, tubular extent which extends downwardly within the interior of the hanger body, the improvement comprising:

a downwardly extending latch collet supported on the outer tubular body, the latch collet having a plurality of externally threaded collet fingers which are adapted to matingly engage an internal thread profile provided in the internal bore of the surrounding hanger body to thereby latch the latch assembly in a latched position within the hanger body; and stop means provided on the exterior of the outer tubular body for initially preventing downward movement of the outer tubular body relative to the hanger body and for preventing the externally threaded collet fingers from engaging the internally threaded profile provided in the internal bore of the hanger body.

20. The improved latch assembly of claim 19, wherein the stop means includes a stop ring located in a recess provided on the exterior of the outer tubular body, the recess including a ramp region which allows downward movement of the stop ring as the outer tubular body is moved upwardly within the surrounding hanger body but which initially prohibits downward movement of the outer tubular body within the surrounding hanger body.

21. The improved latch assembly of claim 20, further comprising connecting means located on the exterior of the outer tubular body for initially connecting the latch assembly to the surrounding hanger body in a recompletion operation prior to the latch collet engaging the internally threaded profile provided in the internal bore of the hanger body.

22. The improved latch assembly of claim 21, further comprising shear release means engageable with the connecting means for maintaining the connecting means in the recompletion position until the latch assembly is moved upwardly relative to the surrounding hanger body.

23. The improved latch assembly of claim 21, wherein the connecting means is a double lobed C-ring having oppositely arranged lobes which extend radially outward from the exterior of the outer tubular body, one of the lobes being adapted to engage a mating groove provided within the internal bore of the hanger body, the opposite lobe being engaged within an internal recess of a triggering ring provided on the exterior of the outer tubular body, and wherein the triggering ring has an internal shoulder which is adapted to engage the stop ring located on the exterior of the outer tubular body for moving the stop ring up the ramp region.

24. The improved latch assembly of claim 23, further comprising an indexing groove provided on the exterior of the outer tubular body for receiving the stop ring after the stop ring passes over the ramp region, the depth of the indexing groove being selected to remove the stop ring from contact with the internal shoulder of the triggering ring to allow the latch assembly to move downwardly relative to the hanger body to thereby latch the latch collet within the mating internal thread profile provided within the internal bore of the surrounding hanger body.

25. The improved latch assembly of claim 24, wherein the inner tubular body has a plurality of external support lands which underlie the externally threaded collet fingers in the latched position and which are axially shiftable from beneath the externally threaded collet fingers in a release position.

26. The improved latch assembly of claim 25, wherein the inner tubular body has a cylindrical fixed portion and an axially aligned, actuating portion which is axially shiftable to move the external support lands to the release position and actuate the release of the latch assembly from within the hanger body, the inner tubular body being initially connected to the axially aligned, actuating portion by a severable joint.

27. A method of re-installing a concentric tubing string within tubing hanger which was previously set in a surrounding well casing in a borehole, the hanger body having an internal bore and an annular packing element carried about the hanger body which is radially expandable under axial compression and having a plurality of circumferentially spaced slips with outer gripping surfaces adapted to grip the surrounding well casing, the method comprising the steps of:

providing a concentric tubing anchor on the concentric tubing string for latching the concentric tubing string within the internal bore of the hanger body;

providing the concentric tubing anchor with latch means adapted to engage a mating profile provided within the internal bore of the hanger body;

providing the concentric tubing anchor with stop means on the exterior thereof for initially preventing downward movement of the tubing anchor relative to the hanger body to prevent the latch means from engaging the mating profile provided in the hanger body, the stop means being movable between an extended radial position and a retracted radial position on the exterior of the concentric tubing anchor;

running the concentric tubing anchor on the concentric tubing string down to the previously set tubing anchor until the concentric tubing anchor shoulders and locates on the tubing anchor;

lifting the concentric tubing string from the well surface so that the concentric tubing anchor is moved axially upward relative to the hanger body, thereby moving the stop means from the extended radial position to the retracted radial position;

adjusting the length of the tubing string extending to the well surface;

reinserting the concentric tubing anchor within the hanger body and moving the concentric tubing anchor axially downward until the latch means engage the mating profile provided in the hanger body to latch the tubing anchor within the hanger body.

28. The method of claim 27, wherein the concentric tubing anchor is provided with an outer tubular body and a concentrically spaced inner tubular body and wherein the stop means includes a stop ring located in a recess provided on the exterior of the outer tubular body, the recess including a ramp region which allows downward movement of the stop ring as the outer tubular body is moved upwardly within the surrounding hanger body but which initially prohibits downward movement of the outer tubular body within the surrounding hanger body.

29. The method of claim 28, wherein upward movement of the outer tubular body causes the stop ring to move from the extended radial position to the retracted radial position on the exterior of the outer tubular body.

30. The method of claim 29, wherein connecting means are provided on the exterior of the outer tubular body for initially connecting the concentric tubing anchor to the surrounding hanger body with the latch means in a spaced-out position.

31. The method of claim 30, wherein shear release means are provided which are engageable with the connecting means for maintaining the connecting means in the spaced-out position until the concentric tubing anchor is moved upwardly relative to the surrounding hanger body.

32. The method of claim 31, wherein the connecting means is a double lobed C-ring having oppositely arranged lobes which extend radially outward from the exterior of the outer tubular body, one of the lobes being adapted to engage a mating groove provided within the internal bore of the hanger body, the opposite lobe being engaged within an internal recess of a triggering ring provided on the exterior of the outer tubular body, and wherein the triggering ring has an internal shoulder which is adapted to engage the stop ring located on the exterior of the outer tubular body for moving the stop ring up the ramp region.

33. The method of claim 32, wherein an indexing groove is provided on the exterior of the outer tubular body for receiving the stop ring after the stop ring passes over the ramp region, the depth of the indexing groove being selected to remove the stop ring from contact with the internal shoulder of the triggering ring to allow the concentric tubing anchor to move downwardly relative to the hanger body to thereby latch the latch means within the mating latch profile provided within the internal bore of the surrounding hanger body.

34. The method of claim 33, wherein the outer tubular body is provided with a downwardly extending latch collet, the latch collet having a plurality of externally threaded collet fingers which are adapted to engage an internal thread profile provided in the internal bore of the surrounding hanger body to thereby latch the concentric tubing anchor in a latch position within the hanger body.

35. The method of claim 34, wherein the inner tubular body is provided with a plurality of external support lands which underlie the externally threaded collet fingers in the latched position and which are axially shiftable from beneath the externally threaded collet fingers in a release position.

36. The method of claim 35, wherein the inner tubular body is provided with a cylindrical fixed portion and an axially aligned, actuating portion which is axially shiftable to move the external support lands to the release position and actuate the release of the concentric tubing anchor from within the hanger body, the inner tubular body being initially connected to the axially aligned, actuating portion by a severable joint.

37. The method of claim 36, further comprising the steps of:

running a release tool from the well surface downwardly within the inner tubular body of the concentric tubing anchor to sever the severable joint between the fixed portion of the inner tubular body from the actuating portion to move the external support lands to the release position and actuate the release of the concentric tubing anchor from within the hanger body; and thereafter retrieving the concentric tubing anchor to the well surface.

* * * * *